United States Patent [19]

Karpluk

[11] 4,000,550

[45] Jan. 4, 1977

[54] APPARATUS FOR CUTTING KNOTS AND SLUBS OUT OF CONTINUOUS YARN LENGTHS

[75] Inventor: Richard William Karpluk, Ballston Lake, N.Y.

[73] Assignee: Albany International Corporation, Albany, N.Y.

[22] Filed: Mar. 8, 1976

[21] Appl. No.: 664,962

[52] U.S. Cl. ..... 28/64

[51] Int. Cl.[2] ..... D01H 13/32

[58] Field of Search ..... 28/64; 73/160; 242/36; 83/451, 452, 63, 80

[56] References Cited

UNITED STATES PATENTS

| | | | |
|---|---|---|---|
| 945,447 | 1/1910 | Cook | 28/64 |
| 1,458,917 | 6/1923 | Bergren | 28/64 |
| 2,572,837 | 10/1951 | Brink | 28/64 |
| 2,657,450 | 11/1953 | Solliday et al. | 28/64 |

*Primary Examiner*—Louis K. Rimrodt

[57] ABSTRACT

Apparatus is disclosed which is useful for severing a continuous length of yarn or monofilament containing knots or slubs, to prevent their takeup into yarn or monofilament processing machinery. The apparatus is advantageous in that it is of simple construction, reliable in operation and positively prevents damage to down-stream processing equipment.

3 Claims, 5 Drawing Figures

APPARATUS FOR CUTTING KNOTS AND SLUBS OUT OF CONTINUOUS YARN LENGTHS

BACKGROUND OF THE INVENTION

1. Field of the Invention

The invention relates to apparatus for processing yarn and monofilament and more particularly relates to apparatus for cutting knots and slubs out of continuous lengths of yarn or monofilament.

2. Brief Description of the Prior Art

Whenever yarns or monofilaments are processed in mechanical equipment requiring its traveling in a single strand, for example in warp dyeing apparatus, weaving looms, spindle winding mechanisms and the like, problems arise when the yarn comes through in a knotted or slubbed condition. Prior hereto, devices have been used through which the yarn or monofilament is required to pass prior to entry into the processing equipment. These devices have a means of catching a knot or slub and preventing continued travel of the yarn. Since the yarn is generally being tracted, for example by a spindle take-up, tension on the yarn increases to the point where the yarn breaks. Such systems are not entirely satisfactory under all circumstances. For example when the yarn has a high tensile strength, the yarn will resist breaking, thereby stalling the spindle take-up and frequently burning out the clutch and/or bearings associated with the spindle take-up. Representative of prior art apparatus designed to solve such or similar problems is that described in U.S. Pat. No. 2,430,507.

The apparatus of the present invention is an improvement over the prior art in that it is relatively simple in construction, reliable in operation and positively prevents the passage of knots or slubs to down-stream processing equipment on a yarn or monofilament process line. The apparatus of the invention is relatively easy to maintain, having a single moving part.

SUMMARY OF THE INVENTION

The invention comprises an apparatus for severing a continuous length of yarn or monofilament containing knots, kinks or slubs, to prevent take-up of said knots, kinks or slubs into yarn and monofilament processing machinery, which comprises: (a) a base support; (b) a pivot axle support attached to said base support; (c) a stationary pivot axle supported by said axle support; (d) a pivot block mounted on said axle so as to pivot freely between a first and a second position, said block having a lead end and a trail end; (e) an open, straight, yarn traveling path through said block, between said lead end and said trail end, the entry to said path being of a dimension permitting the passage of said yarn and monofilament but denying the passage of knots, kinks and slubs in said yarns and monofilaments; (f) means for holding said block in said first position when yarn and monofilament lengths entering the entry to said path are free of knots, kinks and slubs, said means being overcomeable by a predetermined pressure on said lead end, said means being supported by said base support; and (g) means for severing yarn and monofilament lengths after its entering said entry when said block is moved to said second position.

BRIEF DESCRIPTION OF THE DRAWINGS

FIG. 1 is a cross-sectional, side elevation of an embodiment apparatus of the invention shown with a yarn strand traveling through.

DETAILED DESCRIPTION OF THE PREFERRED EMBODIMENTS

An understanding of the invention may be readily obtained by reading the following description of the preferred embodiments in conjunction with the accompanying drawings of FIGS. 1–5, inclusive.

Figure 1:
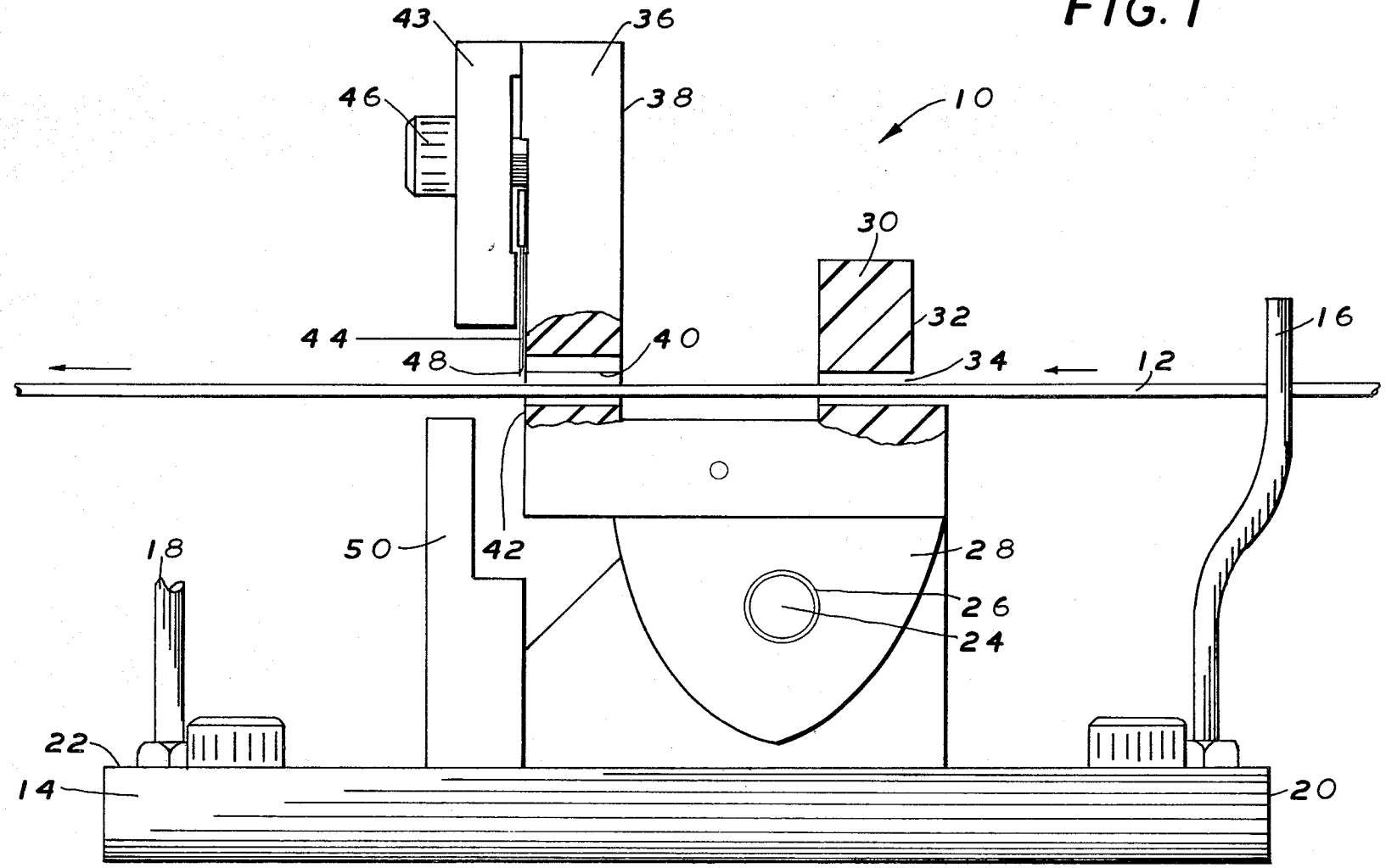

FIG. 1 is a cross-sectional, side elevation of an embodiment apparatus 10 of the invention shown with a yarn strand 12 traveling through in the direction of the arrows. Base plate 14 provides support for the entire apparatus 10 and preferably is of substantial mass or, alternatively, is secured to a substantial mass to prevent movement of the apparatus 10. In the preferred apparatus 10, yarn pigtail guides 16 and 18 are at the lead end 20 and trail end 22, respectively of the apparatus 10. The guides 16, 18 serve to maintain yarn 12 on its direct travel path. The base plate 14 supports a pivot axle support (not seen in FIG. 1) which is attached to base plate 14 and supports a stationary pivot axle 24. In turn, axle 24 supports through journal bearing 26 a pivot block 28 which freely moves or oscillates forward and backward on axle 24. Pivot block 28 is constructed so that it is top heavy (the center of gravity being above the pivot axle) and the major portion of the mass is backward so that block 28 has a normal tendency to rotate towards trail end 22, although such construction is not critical to the invention. Attached to the upper end of pivot block 28 is catcher 30 which comprises a lead end 32 having an entry aperture 34 therein as an initial part of the traveling path traversed by yarn 12 through pivot block 28. The dimension of entry aperture 34 permits the entry of traveling yarn 12 but is insufficient to permit the passage of a knot or slub in said yarn 12. When a knot or slub is in yarn 12, it will strike lead end 32 and stop travel of yarn 12 into entry aperture 34. Also attached to the upper end of block 28 is yarn severing means 36 which comprises mounting member 38 through which yarn 12 passes via passage 40. Passage 40 is in axial alignment with aperture 34 and may be of any dimension sufficient to permit yarn 12 to travel therethrough uninterrupted in its traveling path. Secured to the trail end 42 of pivot block 28 by plate 43 is a yarn severing blade 44. The plate 43 secures blade 44 by a screw fastener 46 for ready removal and replacement of blade 44 as required to maintain a sharp blade edge 48. The blade edge 48 is positioned in alignment with passage 40 but removed from the path normally traversed by the traveling yarn 12. FIG. 1 also shows a stop 50 positioned below the axis of passage 40 but in lateral alignment with the passage 40. The function of stop 50 will be discussed hereinafter.

Figure 2:
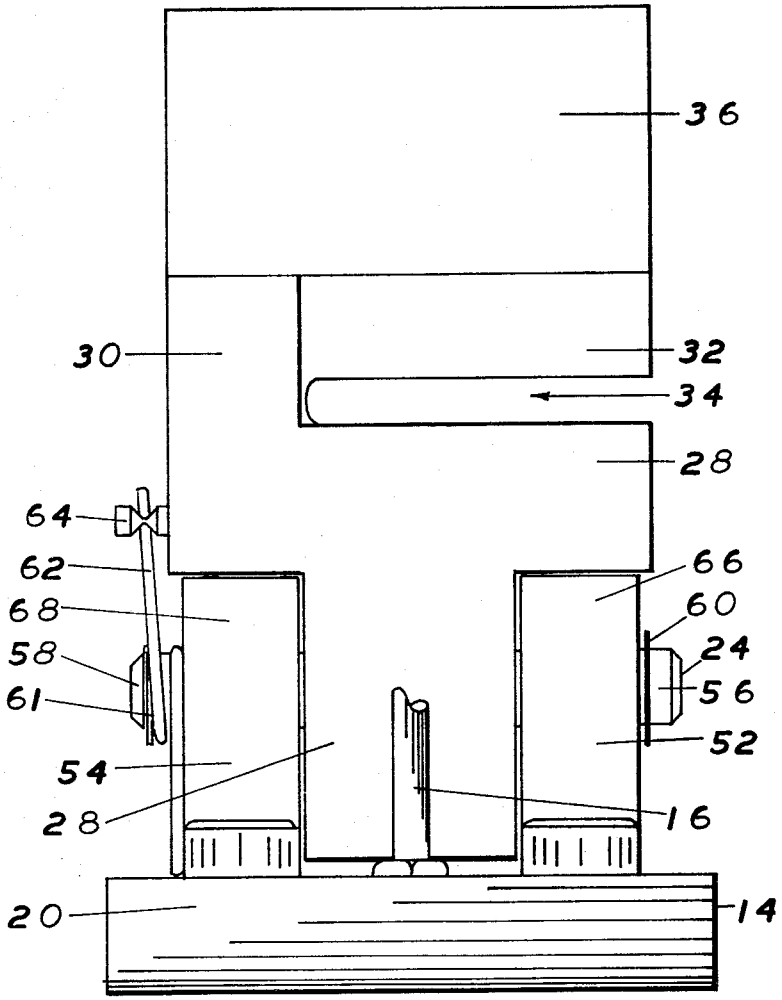
FIG. 2 is an end view of the embodiment of FIG. 1 seen from the point of the entering yarn strand.

Referring now to FIG. 2, a view of lead end 20 of apparatus 10, the pivot axle supports 52, 54 may be seen secured to base plate 14 and supporting ends 56, 58, respectively of axle 24. Axle 24 is held in position by retaining ring 60 on the end 56 and by a return spring 62 and retaining ring 61 on the end 58. Return spring 62 is centered on axle 24 and is secured at its ends by base plate 14 and pin 64 respectively and by retaining ring 61. Pin 64 is attached to pivot block 28 so that return spring 62 ultimately exerts tension on block 28 and forces block 28 into the first position shown in FIG. 1. Movement of block 28 beyond that position towards lead end 20 is restricted by impingement of block 28 against shoulders 66 and 68 of supports 52 and 54 respectively.

Figure 3:
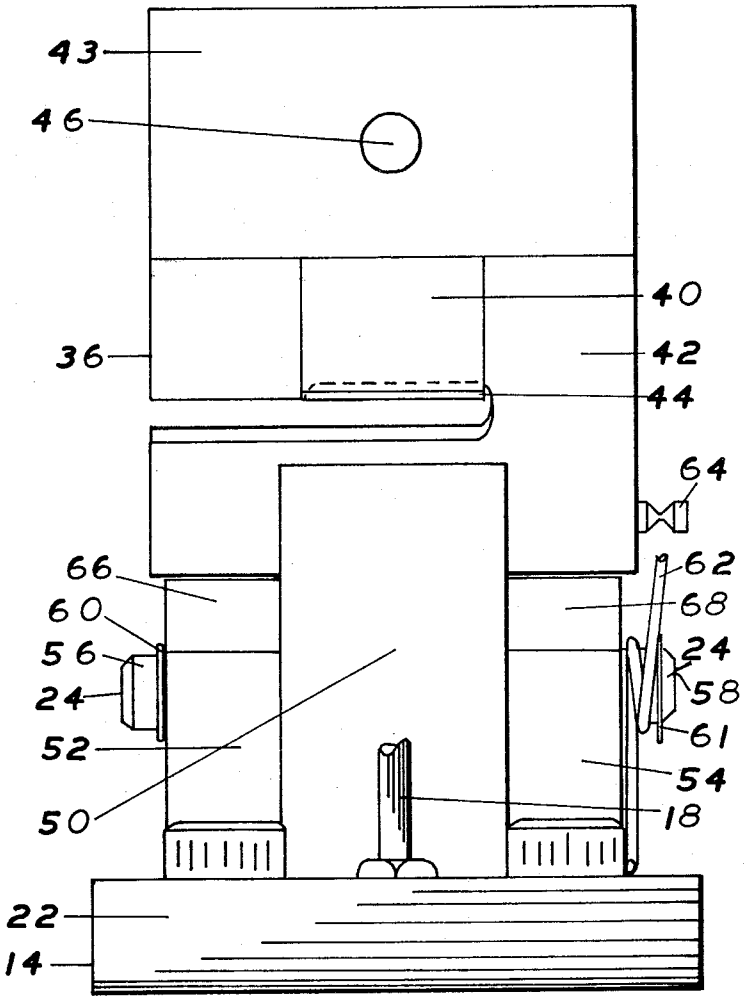
FIG. 3 is an end view of the embodiment of FIG. 1 seen from the point of the departing yarn strand.

FIG. 3 is a view of trail end 22 of apparatus 10 and shows in particular the details of the trail end 42 of block 28 including blade 44, blade edge 48 and stop 50. FIGS. 2 and 3 also show that aperture 34 and passage 40 are open laterally to facilitate threading of yarn 12 through the apparatus 10.

Figure 4:
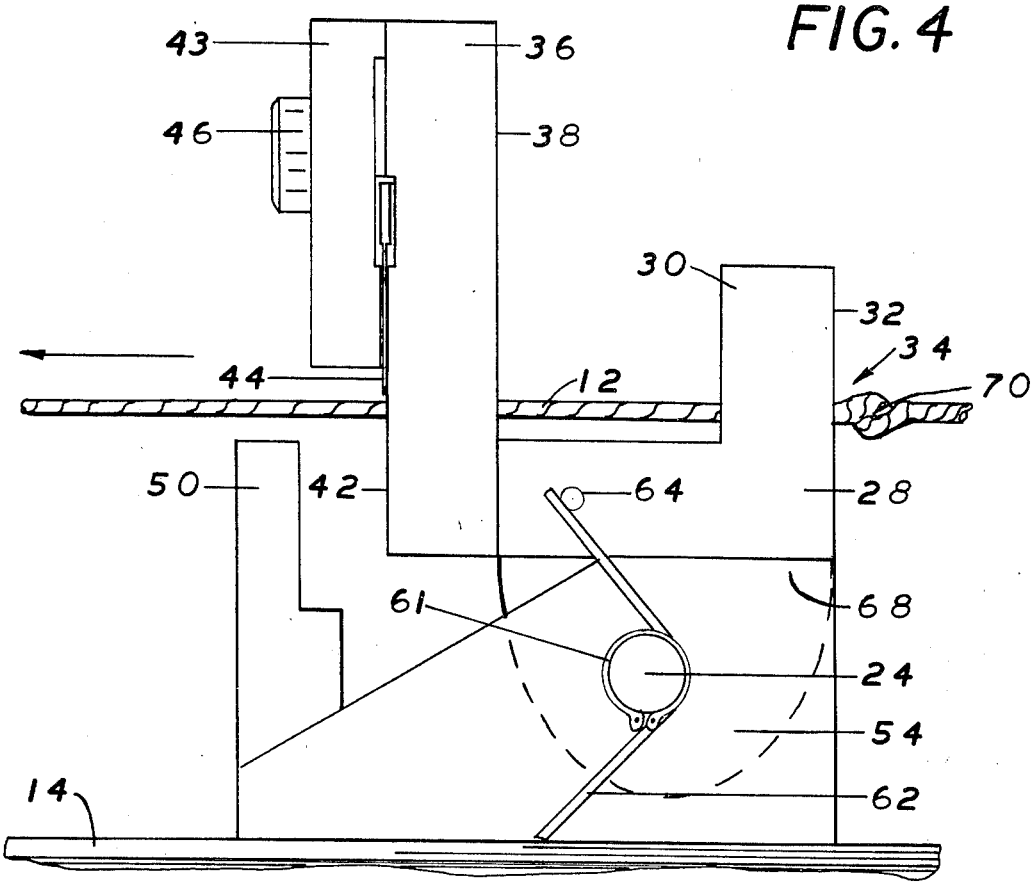
FIG. 4 is a side view of a fragment of the embodiment of FIG. 1 showing the apparatus just prior to entry of a knot in the yarn strand.
Figure 5:
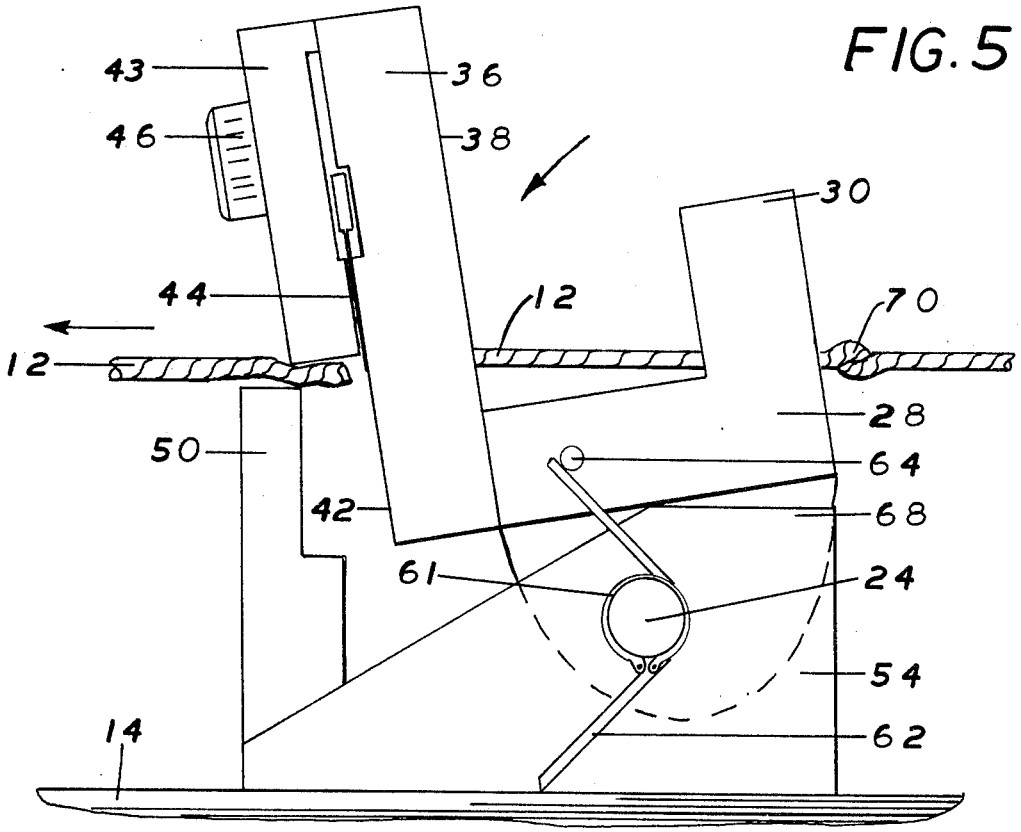
FIG. 5 is a view as in FIG. 4 but after the knot in the strand strikes the apparatus and actuates severing of the yarn strand.

Referring now to FIGS. 4 and 5, the operation of apparatus 10 will be described. In FIG. 4, a side elevation of a fragment of apparatus 10 is seen wherein pivot block 28 is in its first position previously described, i.e.; return spring 62 by exerting pressure on pin 64 holds down block 28 in its most forward position against shoulders 66, 68 (shoulder 66 not seen in FIG. 4). In this position, aperture 34 and passage 40 are axially aligned with the track of traveling yarn 12 so that yarn 12 passes through apparatus 10 without interruption or impingement (see FIG. 1 for detailed view). As shown in FIG. 4, a knot or slub 70 is approaching the entry aperture 34. When knot 34 strikes lead end 32 of block 28, the pressure of the yarn 12 being drawn therethrough overcomes the force exerted by return spring 62 against pin 64 and ultimately against pivot block 28. Pivot block 28 pivots backward towards trail end 22, while compressing spring 62. The downward movement of the trail end 42 of block 28, as shown in FIG. 5 to a second or severing position brings blade edge 48 of blade 44 into the path or track of the traveling yarn 12, severing the yarn and thereby eliminating drag on down-stream processing machinery which would be created by the catching of knot 70. As shown in FIG. 5, severing of line 12 is facilitated by stop 50 which limits the downward displacement of yarn 12 from its track. Stop 50 also halts movement of pivot block 28 in its second or severing position by contact with plate 43. Once yarn 12 has been severed ahead of knot 70, pressure on lead end 32 of block 28 is relieved since the tracted yarn 12 is removed. The pressure of compressed return spring 62 once again moves pivot block 28 to its first position. An operator may then remove knot 70 and rethread yarn 12 passing it through aperture 34 and passage 40 and on to the down-stream processing machinery. In this manner, the down-stream processing machinery is protected from damage caused by a stopped knot or slub.

Those skilled in the art will appreciate that a number of modifications may be made to the preferred embodiment shown in the accompanying drawings of FIGS. 1–5, inclusive, without departing from the spirit of the invention. For example alternative stop means may be used to limit the range of movement of the pivot blocks 28, such as pins, blocks and the like positioned at various points to intercept and stop the pivoting movement. As a further example, the pivot block 28 may completely enclose the track of yarn 12 traveling therethrough.

I claim:

1. An apparatus for severing a continuous length of yarn or monofilament containing knots, kinks, or slubs, to prevent take-up of said knots, kinks or slubs into yarn and monofilament processing machinery, which comprises:

a. a base support;
b. a pivot axle support attached to said base support;
c. a stationary pivot axle supported by said axle support;
d. a pivot block mounted on said axle so as to pivot freely between a first and second position, said block having a lead end and a trail end;
e. first stop means;
f. an open, straight, yarn traveling path through said block, between said lead end and said trail end, the entry to said path being of a dimension permitting the passage of said yarn and monofilament but denying passage of knots, kinks and slubs in said yarns and monofilaments;
g. spring means for yieldingly urging said block in said first position against said first stop means when yarn and monofilament lengths entering the entry to said path are free of knots, kinks and slubs, said spring means being overcomeable by a predetermined pressure on said lead end, said spring means being supported by said base support;
h. blade holder means attached to said pivot block;
i. blade means supported by said blade holder means and disposed adjacent said path when said block is in said first position, said blade means being moveable with said pivot block to enter said path and sever a yarn or monofilament disposed therein upon transfer of said block from said first position to said second position;
j. second stop means against which said blade holder abuts in said second position, said second stop means and said blade holder cooperating in abutment to hold said yarn or monofilament as it is severed by said blade means upon a knot, kink or slub in said yarn or monofilament being denied entry to said path and causing pressure to overcome said spring means to transfer said block from said first position to said second position;
k. and said spring means returning said block to said first position upon release of pressure of the knot, kink or slub upon severance of said yarn or monofilament intermediate said second stop means and the entry of said path.

2. Apparatus according to claim 1 which additionally comprises guide means for guiding said yarn and monofilament prior to and after entering the traveling path through said block.

3. Apparatus according to claim 1 wherein the center of gravity of said block is above said axle.

* * * * *